US011115766B1

(12) United States Patent
Sinelnikov et al.

(10) Patent No.: US 11,115,766 B1
(45) Date of Patent: Sep. 7, 2021

(54) AUTOMATED AUDIO ASSEMBLY PERFORMANCE ASSESSMENT

(71) Applicant: ZEBRA TECHNOLOGIES CORPORATION, Lincolnshire, IL (US)

(72) Inventors: Yegor D. Sinelnikov, Port Jefferson, NY (US); Dongqing Chen, East Setauket, NY (US); David S. Koch, East Islip, NY (US); Jing Lu, Bohemia, NY (US); Neeta R. Joshi, Plano, TX (US); Shan Chu, St. James, NY (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 16/885,489

(22) Filed: May 28, 2020

(51) Int. Cl.
*H04R 29/00* (2006.01)
*G08B 21/18* (2006.01)

(52) U.S. Cl.
CPC ..... *H04R 29/001* (2013.01); *G08B 21/18* (2013.01)

(58) Field of Classification Search
CPC ..... H04R 29/00
See application file for complete search history.

(56) References Cited

U.S. PATENT DOCUMENTS 7,593,781 B1 * 9/2009 Rhea ..... G06F 3/162 381/58
2003/0065276 A1 * 4/2003 Akita ..... A61B 5/121 600/559
2007/0025557 A1 * 2/2007 Nackvi ..... H04S 7/301 381/59
2007/0100572 A1 * 5/2007 Zhang ..... G06F 3/162 702/103
2009/0280800 A1 * 11/2009 Liu ..... H04W 24/00 455/425
2009/0304195 A1 * 12/2009 Fillol ..... H04R 29/007 381/59
2010/0074451 A1 * 3/2010 Usher ..... H04R 29/00 381/58
2010/0191143 A1 * 7/2010 Ganter ..... A61B 5/121 600/559
2010/0272270 A1 * 10/2010 Chaikin ..... H04R 29/001 381/59
2013/0083935 A1 * 4/2013 Yang ..... H04R 29/00 381/58
2013/0129097 A1 * 5/2013 Park ..... H04M 1/24 381/56
2014/0369512 A1 * 12/2014 Slupeiks ..... H04R 3/00 381/59

(Continued)

*Primary Examiner* — Olisa Anwah
(74) *Attorney, Agent, or Firm* — Yuri Astvatsaturov

(57) ABSTRACT

A computing device includes: a memory storing an audio sequence and a reference attribute associated with playback of the audio sequence; a speaker; a microphone; an audio enclosure supporting the speaker and the microphone; a processor configured to: simultaneously (i) control the speaker to play the audio sequence, and (ii) control the microphone to capture a test recording corresponding to playback of the audio sequence; based on a comparison of the reference attribute to a test attribute associated with the test recording, detect occlusion of the audio enclosure; and in response to detecting occlusion of the audio enclosure, generate a notification message.

23 Claims, 7 Drawing Sheets

(56) References Cited

U.S. PATENT DOCUMENTS

| | | | | |
|---|---|---|---|---|
| 2015/0304786 | A1* | 10/2015 | Partio | H04R 29/004 381/58 |
| 2017/0084294 | A1* | 3/2017 | Hartung | H04R 27/00 |
| 2017/0231535 | A1* | 8/2017 | Lasry | G06F 19/00 600/559 |
| 2018/0018984 | A1* | 1/2018 | Dickins | G10L 21/0232 |
| 2018/0255412 | A1* | 9/2018 | Ouyang | B08B 7/026 |
| 2019/0075403 | A1* | 3/2019 | Wurzbacher | H04R 25/30 |
| 2020/0322724 | A1* | 10/2020 | Lim | G06F 3/0484 |

* cited by examiner

AUTOMATED AUDIO ASSEMBLY PERFORMANCE ASSESSMENT

BACKGROUND

Mobile computing devices such as tablet computers, smart phones and the like may be provided with speakers, receivers and microphones, which may be disposed behind a grill, a port in a housing of the computing device, or the like. The characteristics of grills, ports or other supporting structures for audio components may be altered by debris or damage. Such alterations may degrade audio performance of the computing devices.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
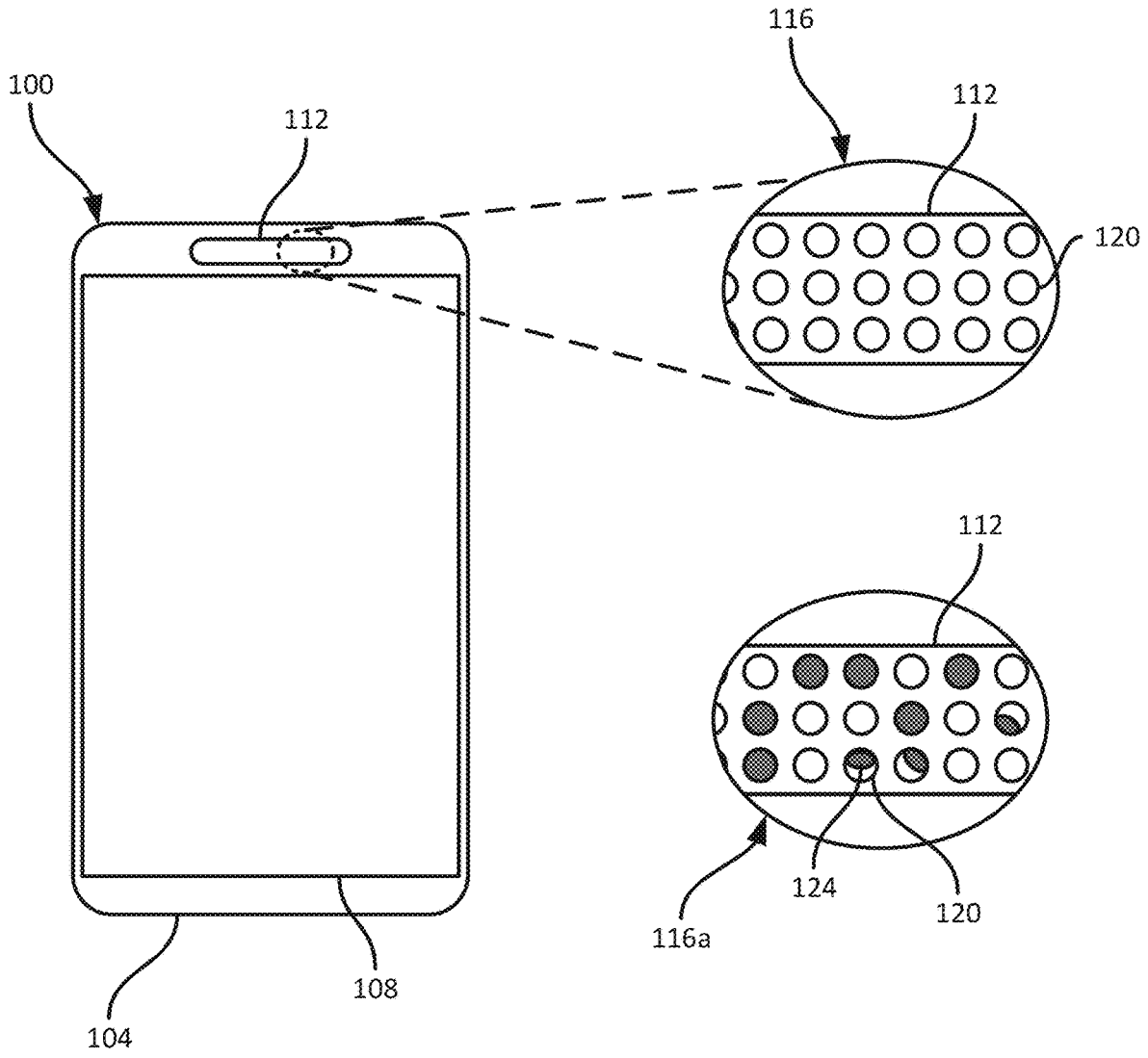
FIG. 1 is a schematic of a mobile computing device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Examples disclosed herein are directed to a computing device including: a memory storing an audio sequence and a reference attribute associated with playback of the audio sequence; a speaker; a microphone; an audio enclosure supporting the speaker and the microphone; a processor configured to: simultaneously (i) control the speaker to play the audio sequence, and (ii) control the microphone to capture a test recording corresponding to playback of the audio sequence; based on a comparison of the reference attribute to a test attribute associated with the test recording, detect occlusion of the audio enclosure; and in response to detecting occlusion of the audio enclosure, generate a notification message.

Additional examples disclosed herein are directed to a method, comprising: simultaneously (i) controlling a speaker to play the audio sequence, and (ii) controlling a microphone to capture a test recording corresponding to playback of the audio sequence; based on a comparison of the reference attribute to a test attribute associated with the test recording, detecting occlusion of an audio enclosure containing the speaker and the microphone; and in response to detecting occlusion of the audio enclosure, generating a notification message.

FIG. 1 shows a mobile computing device 100, such as a smart phone. The device 100 may be implemented as a tablet computer, laptop computer or the like in other examples. The device 100 includes a housing 104 that supports various other components of the device 100, such as a display 108 (e.g. and integrated touch screen). The device 100 can also include an audio assembly 112 supported by the housing 104. The audio assembly 112 can include at least one microphone and at least one speaker (not visible in FIG. 1), housed in an enclosure with a port or plurality of ports (e.g. a grill). The ports can be an integral portion of the housing 104, or a separate component supported by the housing 104.

Example ports 120 of the audio assembly 112 are shown in the detail view 116 of FIG. 1, forming a grill behind which the speaker(s) and microphone(s) are located. As will be apparent to those skilled in the art, the ports 120 may become damaged, occluded or otherwise altered through use of the device 100, cleaning of the device 100, and the like. For example, when the device 100 is deployed for use in a healthcare setting, the device 100 may be frequently cleaned with disinfectant wipes or the like, resulting in an accumulation of fibers or other debris 124 in at least some of the ports 120, as shown in the alternative detail view 116*a*.

The debris 124 in the ports, as well as damage to the ports 120 (e.g. due to impact suffered by the device 100) may reduce the performance of the speaker(s) and/or microphone(s). The device 100 therefore implements certain functionality, described herein, to periodically assess the performance of the audio assembly 112 and detect changes in audio performance that indicate structural changes to the assembly 112 such as debris or physical damage. The device 100 may therefore enable detection of degraded audio performance and trigger maintenance procedures such as cleaning or replacement of the assembly 112.

Figure 2:
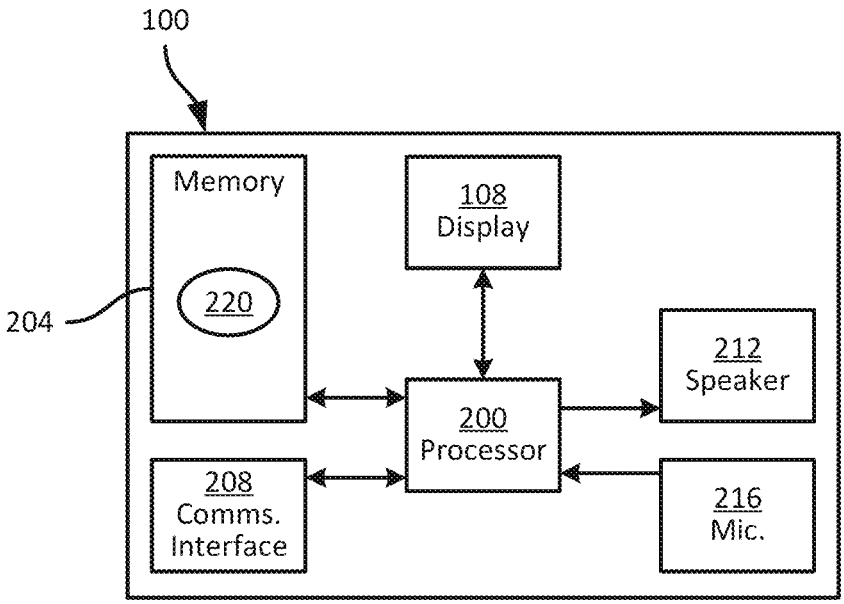
FIG. 2 is a block diagram of certain internal hardware components of the computing device of FIG. 1.

Turning to FIG. 2, certain internal components of the device 100 are illustrated. The computing device 100 includes a controller, such as a processor 200, interconnected with a non-transitory computer readable storage medium, such as a memory 204. The memory 204 includes a combination of volatile memory (e.g. Random Access Memory or RAM) and non-volatile memory (e.g. read only memory or ROM, Electrically Erasable Programmable Read Only Memory or EEPROM, flash memory). The processor 200 and the memory 204 each comprise one or more integrated circuits. The computing device 100 also includes a communications interface 208 enabling the computing device 100 to exchange data with other computing devices via a suitable network.

The device 100 also includes the display 108 as noted above, a speaker 212 and a microphone 216. The speaker 212 and microphone 216 are components of the audio assembly 112 shown in FIG. 1. The device 100 may include additional speakers and/or microphones in the assembly 112 in other examples. In further examples, the device 100 may include a plurality of distinct audio assemblies, each located on a corresponding portion of the device 100 and including at least one speaker and at least one microphone.

The memory 204 stores computer readable instructions for execution by the processor 200. In particular, the memory 204 stores an audio performance assessment application 220 which, when executed by the processor 200, configures the processor 200 to control the speaker 212 and microphone 216 to detect occlusions of the ports 120 or other disruptions to the audio assembly 112. Those skilled in the art will appreciate that the functionality implemented by the processor 200 via the execution of the application 220 may also be implemented by one or more specially designed hardware and firmware components, such as FPGAs, ASICs and the like in other embodiments.

Figure 3:
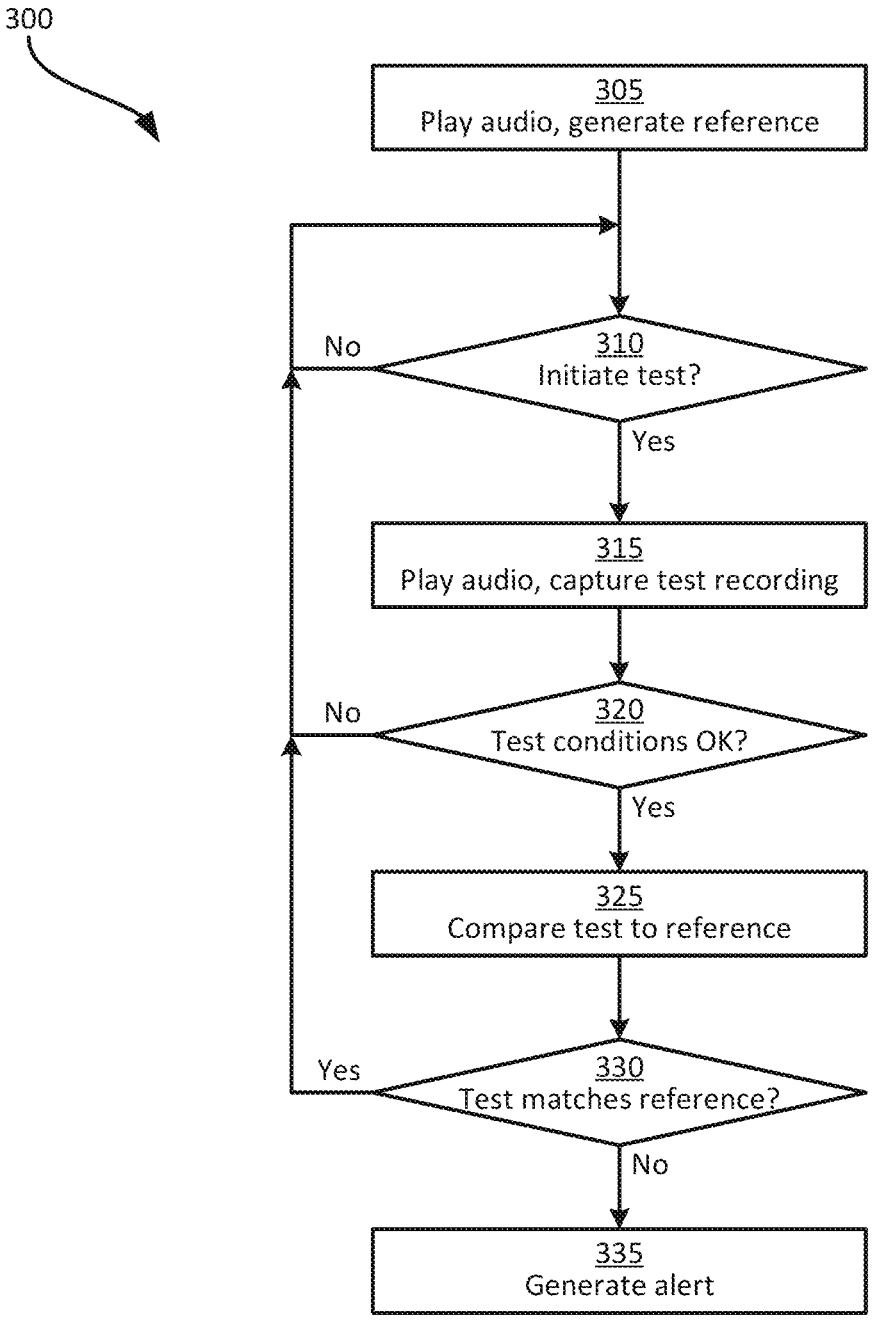
FIG. 3 is a flowchart of a method of audio assembly performance assessment.

Turning now to FIG. 3, the functionality implemented by the computing device 100 will be discussed in greater detail. FIG. 3 illustrates a method 300 of automatically assessing audio performance, which will be discussed below in conjunction with its performance by the computing device 100.

As will be discussed below, the assessment of current audio performance to determine whether the ports 120 are occluded or damaged is performed by comparing data reflective of current audio performance to data reflective of reference audio performance. The reference audio performance is the performance of the audio assembly 112 when it is known not to be affected by occlusions, damage or the like. The functionality implemented via execution of the application 220 may therefore begin by obtaining such reference data.

In particular, at block 305 the processor 200 can be configured to play a predetermined audio sequence via the speaker 212, and generate at least one reference attribute associated with playback of the audio sequence. The audio sequence can be stored in the memory 204 in association with the application 220. At block 305, the processor 200 can therefore be configured to retrieve the audio sequence from the memory 204 and control the speaker 212 to play the audio sequence. Simultaneously with such playback, the processor 200 controls the microphone 216 to capture a reference recording associated with playback of the audio sequence. In other words, the reference recording is a recording of the speaker 212 playing the audio sequence.

Block 305 may be performed automatically upon a first startup of the device 100, or in response to an operator input indicating that the device 100 is in a reference state (e.g. the assembly 212 has been replaced, cleaned or the like), or loaded onto all devices of the same type and manufacturing batch in the factory as part of quality control. Thus, the reference recording captured at block 305 is assumed to represent an ideal level of performance of the audio assembly 112.

Figure 4:
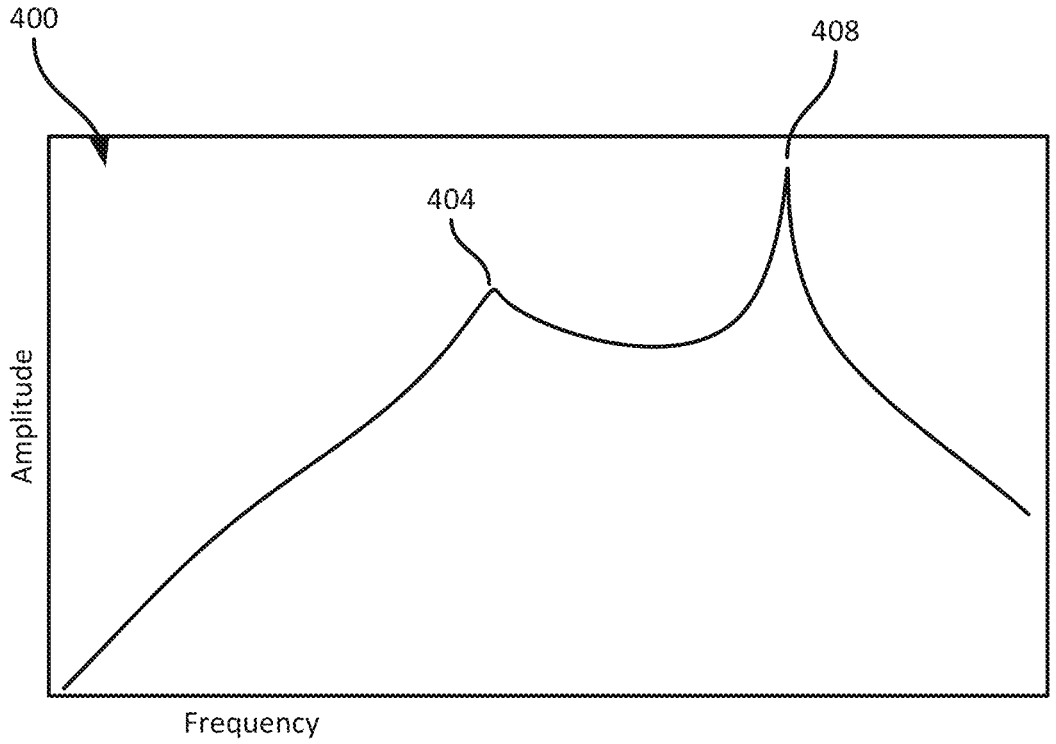
FIG. 4. is a diagram illustrating an example reference attributed employed in the method of FIG. 3.

The reference attribute generated at block 305 can be the reference recording itself in some examples. In other examples, the reference attribute includes one or more attributes derived from the reference recording. Examples of reference attributes include one or more representations of the recorded power of the reference recording, such as root mean square (RMS) measurements, Mel-frequency cepstral coefficients (MFCC) and the like. Another example reference attribute includes a resonant frequency detected from the reference recording. For example, turning to FIG. 4, a plot 400 of frequencies and corresponding amplitudes from the reference recording is illustrated. The plot 400 displays two peaks 404 and 408. The frequency of the first peak 404 typically corresponds to the resonant frequency of the speaker 212 itself, while the frequency of the second peak 408 may correspond to a resonant frequency of the ports 120. The processor 200 may therefore be configured to detect the peaks (at least the second peak 408, and optionally both peaks 404 and 408) and store the frequency at which the second peak 408 appears.

In some examples, multiple porting frequencies may be present (e.g. as distinct peaks), and more than one such resonant frequency may be employed as a reference attribute. In further examples, a front porting full width half maximum (FWHM) or other quality indicator may be employed as a reference attribute, instead of or in addition to the front porting resonance frequency itself. The FWHM may indicate how sharp the resonance peak is in the reference recording, and certain substances may render port resonances less well-defined (i.e. lower, broader peaks), which will be reflected in test FWHMs. More generally, the reference attribute may therefore be derived from at least one resonant frequency, whether the reference attribute is the resonant frequency itself or a related attribute such as the FWHM.

Figure 5A:
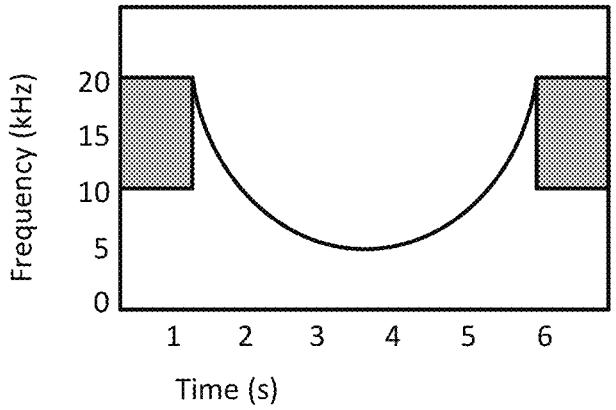
FIGS. 5A, 5B, and 5C are diagrams illustrating example audio sequences used at blocks 305 and 315 of the method of FIG. 3.
Figure 5B:
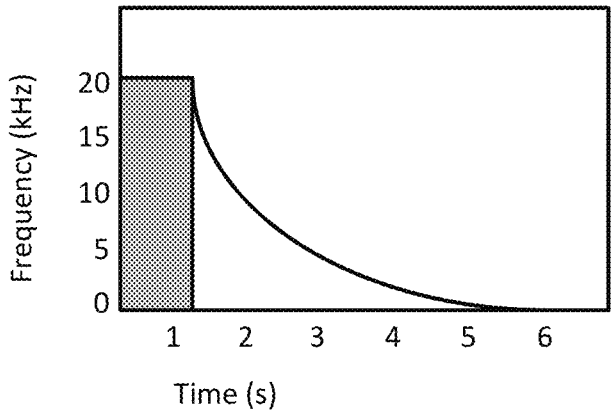
Figure 5C:
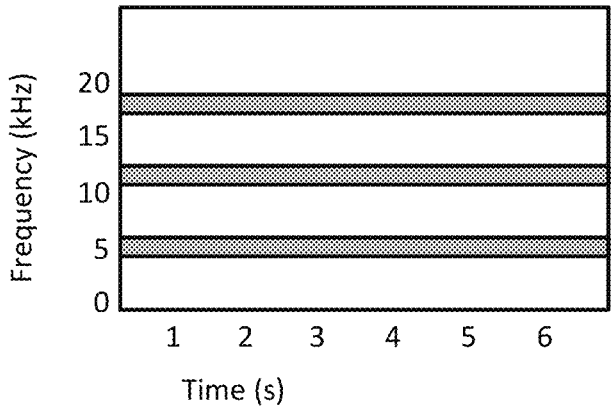

The audio sequence itself, which is employed both at block 305 and in subsequent portions of the method 300 to assess audio performance of the assembly 112, can take a wide variety of forms. FIGS. 5A, 5B, and 5C illustrate example audio sequences employed in the method 300. In the example of FIG. 5A, the audio sequence is an M-shaped sequence beginning with a tone spanning 10 to 20 kHz, dropping to about 5 kHz, and then rising again to about 20 kHz before terminating with a 10-20 kHz tone.

In the example of FIG. 5B, the audio sequence begins with a tone spanning all frequencies up to about 20 kHz, and then sweeps downwards to 0 kHz. In the example of FIG. 5C, the audio sequence includes three tones played continuously, at about 5 kHz, 12 kHz and 18 kHz. A wide variety of other audio sequences may also be employed, including pink noise at various frequencies, and the like.

Generally, the audio sequences may employ primarily, or exclusively, frequencies near or above the upper portion of the range of human hearing (e.g. above about 13 kHz). In some examples, the audio sequences may employ frequencies entirely outside the normal range of human hearing (e.g. above about 20 kHz). The use of such relatively high frequencies may reduce disruption to activities of the operator of the device 100 during automated assessment of audio performance. The use of relatively high frequencies may also reduce interference from environmental noise in the recordings captured by the device 100, as such interference is less likely to have the same frequencies as the audio sequence.

More generally, therefore, the audio sequences may have power spectral densities (PSDs) for lower frequencies that are smaller than their power spectral densities for higher frequencies. For example, the audio sequences may have PSDs below 4 kHz that are lower than their PSDs above 4 kHz by at least 40 dB. In other examples, the audio sequences may have PSDs below 8 kHz that are lower than their PSDs above 8 kHz by at least 37 dB. In further examples, the audio sequences may have PSDs below 4 kHz that are lower than their PSDs above 4 kHz by at least 33 dB.

Returning to FIG. 3, at block 310 the processor 200 is configured to determine whether to initiate a performance assessment for the audio assembly 112. The determination at block 310 can be performed automatically, rather than in response to an operator command. The processor 200 can, for example, determine whether a configurable period of time has elapsed since the previous assessment (e.g. one week). When the determination at block 310 is negative, the device 100 repeats the performance of block 310.

When the determination at block 310 is affirmative, the device 100 proceeds to block 315. At block 315, the processor 200 controls the speaker 212 to play the audio sequence mentioned above, and simultaneously controls the microphone 216 to capture a test recording of the playback of the audio sequence. The test recording can be stored in the memory 204 for further processing.

At block 320, the processor 200 can determine whether environmental conditions during the performance of block 315 are acceptable. For example, the test recording (or attributes derived therefrom) may deviate substantially from the reference recording if the conditions under which the recordings were obtained differ. The processor 200 may therefore be configured to evaluate any of a variety of conditions at block 320, including conditions indicated by the test recording itself and conditions indicated by other sensor data.

For example, the processor 200 may determine an average amplitude for the test recording and compare the amplitude to an average amplitude for the reference recording. If the amplitudes differ by an amount greater than a preconfigured threshold, the determination at block 320 is negative. Divergent amplitudes may indicate, for example, that the test recording was captured while the device 100 was in a bag, pocket or the like, while the reference recording was captured while the device 100 was in open air. In other examples, the processor 200 may determine via a light sensor, camera or the like whether an ambient light level during the performance of block 315 matches a stored ambient light level during the performance of block 305.

When the determination at block 320 is negative, the processor 200 can discard the test recording and return to block 310. When the determination at block 320 is affirmative, the processor 200 proceeds to block 325. In other examples, block 320 can simply be omitted. In further examples, the determination at block 320 can be performed before block 315. In particular, implementations in which the determination at block 320 depends on other sensor data than the test recording itself (e.g. camera data), the determination at block 320 may be performed before initiating playback of the audio sequence and capture of the test recording.

At block 325, the processor 200 is configured to compare the test recording to the reference recording. More specifically, the processor 200 is configured to compare a test attribute derived from the test recording to the reference attribute mentioned earlier (which was, in turn, derived from the reference recording from block 305).

The test attribute derived from the test recording is the same as the reference attribute described in connection with block 305. Thus, the test attribute can include the test recording itself, RMS samples from the test recording, or the like. A plurality of test attributes can also be generated, and the comparison at block 325 can therefore involve multiple distinct comparisons of reference and test attributes.

The comparison at block 325 yields an indication of a degree of difference between the reference recording and the test recording. Therefore, the comparison can be implemented according to a suitable function for determining the degree of similarity between data series. Examples of such functions include the Log-Euclidian distance, assessed by the Kolmogorov-Smirnov test (KS test), the Welch t-test, and the like. Combinations of the output of such functions may also be employed (e.g. a different function may be applied for each compared attribute, and the resulting scores or other outputs from the functions may be summed, averaged or the like).

Figure 6:
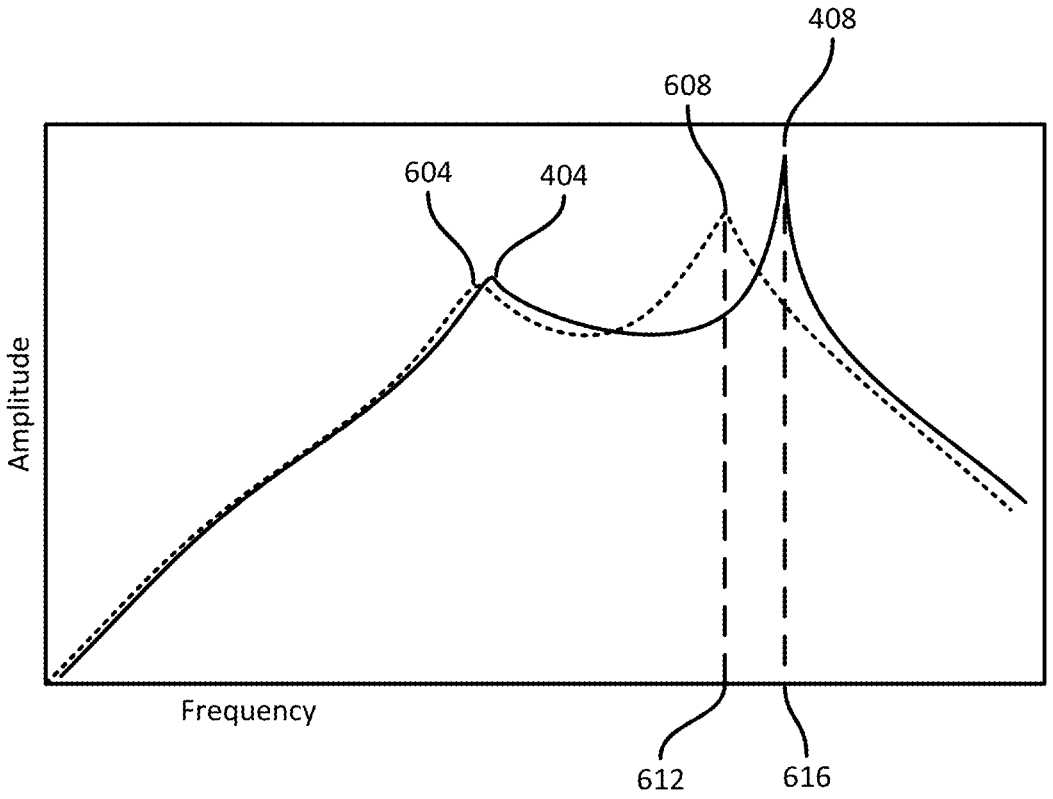
FIG. 6 is a diagram illustrating an example performance of block 325 of the method of FIG. 3.

In some examples, rather than the above-mentioned statistical functions, the test attribute and the reference attribute may be suitable for direct comparison, such that the performance of block 325 can include a subtraction of the test attribute from the reference attribute, or vice versa. For example, when the reference attribute is the frequency of the second peak 408 mentioned earlier, the processor 200 determines a frequency of a second peak in the test recording, corresponding to the resonant frequency of the ports 120 at the time of the test recording. The reference peak 408 and the test peak can then be compared. Turning to FIG. 6, a plot of frequency and amplitude for a test recording is shown overlaid on the plot from FIG. 4. The processor 200 can be configured to detect a first peak 604 (the resonant frequency of the speaker 212) and a second peak 608 (the resonant frequency of the ports 120) from the test recording, and compare the frequencies corresponding to the peaks 408 and 608.

Returning to FIG. 3, at block 330 the processor 200 is configured to determine whether the test recording matches the reference recording sufficiently to indicate that the ports 120 are not occluded or otherwise compromised. The processor 200 can be configured to compare the difference between test and reference attributes determined at block 325 to a threshold. When the difference exceeds the threshold, the determination at block 330 is negative.

For example, in the example of FIG. 6, the difference between the frequency 612 corresponding to the peak 608, and the frequency 616 corresponding to the peak 408 may be 1500 Hz, while the threshold at block 330 is 1 kHz. The determination at block 330 is therefore negative, and the processor 200 proceeds to block 335. When the determination at block 330 is affirmative, the test recording sufficiently resembles the reference recording to indicate that the ports 120 have not been occluded or otherwise compromised, and the processor returns to block 310.

Following a negative determination at block 330, the processor is configured to generate an alert at block 335. The alert can be generated by transmitting a message via the communications interface 208, e.g. to a server or other computing device that stores a maintenance log, executes fleet management functionality or the like. The alert can also be generated by rendering a notification on the display 108, e.g. informing an operator of the device 100 that the audio assembly 112 requires maintenance (e.g. cleaning of the ports 120 or replacement).

Variations to the above functions are contemplated. In some examples, in addition to comparing the test recording to the reference recording (or attributes derived therefrom) the processor 200 can also compare a current test recording to previous test recordings. For example, test recordings from successive performances of block 315 can be stored in the memory, and in addition to evaluating the difference between the reference recording and the current test recording, the processor 200 can be configured to evaluate the difference between the current test recording and one or more preceding test recordings.

More specifically, the determination at block 330 can be expanded to assess both the difference between the current test recording and the reference recording against a first threshold, and to assess the difference between the current test recording and a preceding test recording against a second threshold. When either of the above thresholds is exceed, the determination at block 330 may be negative.

That is, even if the test recording does not differ significantly from the reference recording, if the test recording shows sufficient change over time, the alert at block 335 may nevertheless be generated.

In further embodiments, the reference attributes employed at block 330 can include not only attributes associated with the reference recording as described above, but also attributes associated with a stored recording that corresponds to a defective device. The defective recording can be loaded into the memory 220 at the time of manufacture of the device 100, retrieved from a server, or the like. The defective recording is captured from a device known to have a clogged or otherwise defective audio assembly. Thus, at block 330 the device 100 can compare the test recording to at least one "good" recording (e.g. the reference recording discussed earlier), and at least one "bad" recording (e.g. the defective recording mentioned above).

For example, the device 100 can assess the Log-Euclidean distances between (i) a sliding RMS window of the test recording and the good recording, and (ii) the sliding RMS window of the test recording and the bad recording. Such distances may be assessed against a proximity threshold using the logarithm of geometric mean computation. For example, if the test recording is within the proximity threshold of the reference recording the determination at block 330 may be affirmative, whereas if the test recording is within the proximity threshold of the defective recording the determination at block 330 may be negative. In some examples, when the test recording is further from the reference recording than from the defective recording, the determination at block 330 may be negative.

Figure 7:
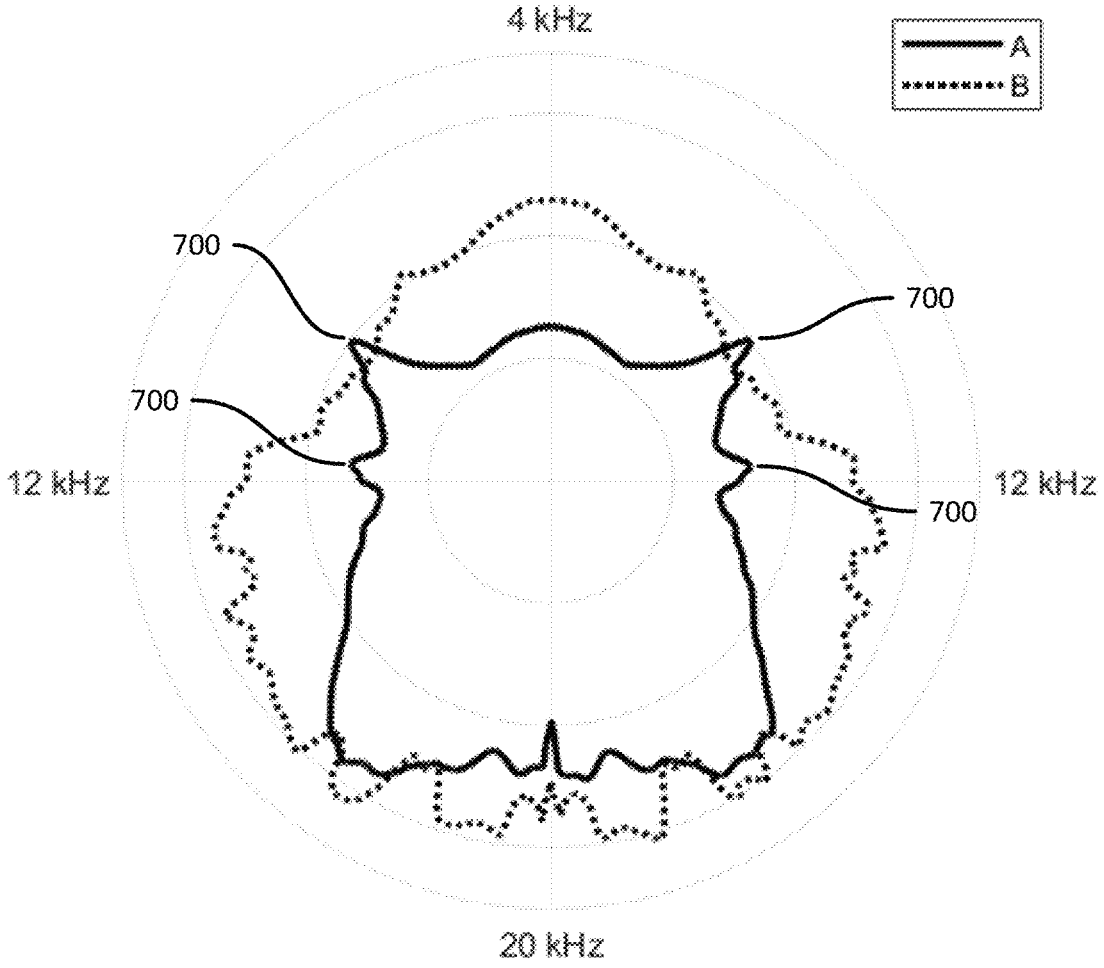
FIG. 7 is a diagram illustrating polar logarithmic plots of reference and defective recordings presented on a display of the device of FIG. 1.

The results of the above assessment may also be presented on the display 108 in some implementation. For example, turning to FIG. 7, a first polar logarithmic plot "A" is shown corresponding to a reference recording, and a second polar logarithmic plot "B" is shown corresponding to a defective recording. As can be seen in FIG. 7, the plot A reveals visually distinguishable peaks 700 at resonance frequencies, while the plot B is larger and displays fewer or no readily distinguishable peaks. The test recording can be presented on the display 108 as an overlay to the plots shown in FIG. 7 (i.e. as a third plot), enabling an operator of the device 100 to visually compare the test recording to the reference and defective recordings.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A computing device, comprising:

a memory storing an audio sequence and a reference attribute associated with playback of the audio sequence;

a speaker;

a microphone;

an audio enclosure supporting the speaker and the microphone;

a processor configured to:

simultaneously (i) control the speaker to play the audio sequence, and (ii) control the microphone to capture a test recording corresponding to playback of the audio sequence;

based on a comparison of the reference attribute to a test attribute associated with the test recording, detect occlusion of the audio enclosure; and in response to detecting occlusion of the audio enclosure, generate a notification message, wherein the reference attribute is derived from a reference recording of the audio sequence, and wherein the processor is further configured to generate the reference recording by simultaneously (i) controlling the speaker to play the audio sequence, and (ii) controlling the microphone to capture the reference recording.

2. The computing device of claim 1, wherein the reference attribute is derived from a resonance frequency.

3. The computing device of claim 2, wherein the resonance frequency corresponds to a port of the enclosure.

4. The computing device of claim 1, wherein the reference attribute includes at least one of a root mean square (RMS), a Mel-frequency cepstral coefficient (MFCC), and a full width half maximum (FWHM) of a resonance above said a frequency.

5. The computing device of claim 1, wherein the reference attribute is derived from a resonance frequency detected from a reference recording.

6. The computing device of claim 1, further comprising a display; wherein the processor is further configured to render the notification message on the display.

7. The computing device of claim 1, further comprising a communications interface; wherein the processor is further configured to transmit the notification message via the communications interface.

8. The computing device of claim 1, wherein the processor is further configured to repeat playback of the audio sequence and capture of the test recording according to a predetermined time period.

9. The computing device of claim 1, wherein the audio sequence has a power spectral density below a first frequency that is lower than a power spectral density above the first frequency by at least 30 dB.

10. The computing device of claim 9, wherein the first frequency includes one of 4 kHz and 8 kHz.

11. A method, comprising:

simultaneously (i) controlling a speaker to play the audio sequence, and (ii) controlling a microphone to capture a test recording corresponding to playback of the audio sequence;

based on a comparison of the reference attribute to a test attribute associated with the test recording, detecting occlusion of an audio enclosure containing the speaker and the microphone; and in response to detecting occlusion of the audio enclosure, generating a notification message, wherein the audio sequence has a power spectral density below a first frequency that is lower than a power spectral density above the first frequency by at least 30 dB.

12. The method of claim 11, wherein the reference attribute is derived from a reference recording of the audio sequence.

13. The method of claim 12, wherein the reference attribute is derived from a resonance frequency.

14. The method of claim 13, wherein the resonance frequency corresponds to a port of the enclosure.

15. The method of claim 12, further comprising: generating the reference recording by simultaneously (i) controlling the speaker to play the audio sequence, and (ii) controlling the microphone to capture the reference recording.

16. The method of claim 11, wherein the reference attribute includes at least one of a root mean square (RMS), a Mel-frequency cepstral coefficient (MFCC), and a full width half maximum (FWHM) of a resonance above a first frequency.

17. The method of claim 11, wherein the reference attribute is derived from a resonance frequency detected from a reference recording.

18. The method of claim 11, further comprising: rendering the notification message on the display.

19. The method of claim 11, further comprising: transmitting the notification message via a communications interface.

20. The method of claim 11, further comprising repeating playback of the audio sequence and capture of the test recording according to a predetermined time period.

21. The method of claim 11, wherein the first frequency includes one of 4 kHz and 8 kHz.

22. A computing device, comprising:

a memory storing an audio sequence and a reference attribute associated with playback of the audio sequence;

a speaker;

a microphone;

an audio enclosure supporting the speaker and the microphone;

a processor configured to:

simultaneously (i) control the speaker to play the audio sequence, and (ii) control the microphone to capture a test recording corresponding to playback of the audio sequence;

based on a comparison of the reference attribute to a test attribute associated with the test recording, detect occlusion of the audio enclosure; and in response to detecting occlusion of the audio enclosure, generate a notification message, wherein the reference attribute is derived from a resonance frequency detected from a reference recording.

23. A computing device, comprising:

a memory storing an audio sequence and a reference attribute associated with playback of the audio sequence;

a speaker;

a microphone;

an audio enclosure supporting the speaker and the microphone;

a processor configured to:

simultaneously (i) control the speaker to play the audio sequence, and (ii) control the microphone to capture a test recording corresponding to playback of the audio sequence;

based on a comparison of the reference attribute to a test attribute associated with the test recording, detect occlusion of the audio enclosure; and in response to detecting occlusion of the audio enclosure, generate a notification message, wherein the audio sequence has a power spectral density below a first frequency that is lower than a power spectral density above the first frequency by at least 30 dB.

* * * * *